US006612355B1

(12) United States Patent
Cook et al.

(10) Patent No.: US 6,612,355 B1
(45) Date of Patent: Sep. 2, 2003

(54) DISK LABEL APPLICATOR DEVICE

(75) Inventors: Steven Cook, Oceanside, CA (US); Jim Mayall, Carlsbad, CA (US)

(73) Assignee: Microvision Development, Inc., Carlsbad, CA (US)

( * ) Notice: Subject to any disclaimer, the term of this patent is extended or adjusted under 35 U.S.C. 154(b) by 58 days.

(21) Appl. No.: 09/766,809

(22) Filed: Jan. 22, 2001

(51) Int. Cl.[7] ..... B65C 1/00; B65C 1/02; B65C 9/26

(52) U.S. Cl. ..... 156/391; 156/556; 156/580; 156/DIG. 1; 156/DIG. 2

(58) Field of Search ..... D6/634, 632; D14/479; 206/307, 308.1; 156/391, 556, 580

(56) References Cited

U.S. PATENT DOCUMENTS

| | | | | | |
|---|---|---|---|---|---|
| 5,316,464 | A | | 5/1994 | Lexell | |
| 5,421,950 | A | | 6/1995 | Parrish | |
| 5,543,001 | A | | 8/1996 | Casillo et al. | |
| 5,715,934 | A | * | 2/1998 | Tobol et al. | 206/308.1 |
| 5,783,031 | A | | 7/1998 | Sievers | |
| 5,783,033 | A | | 7/1998 | Grossman | |
| 5,896,986 | A | * | 4/1999 | Bolognia et al. | 206/310 |
| 5,902,446 | A | | 5/1999 | Casillo et al. | |
| 5,925,200 | A | | 7/1999 | Grossman | |
| 5,951,819 | A | | 9/1999 | Hummell et al. | |
| D430,424 | S | * | 9/2000 | Belden, Jr. et al. | D6/407 |
| 6,302,176 | B1 | * | 10/2001 | Chen | 156/391 |
| 6,311,835 | B1 | * | 11/2001 | Okuhara et al. | 206/308.1 |
| 6,321,811 | B1 | * | 11/2001 | Atkinson et al. | 156/391 |
| 6,347,654 | B1 | * | 2/2002 | Koch | 156/391 |
| 6,484,777 | B1 | * | 11/2002 | Quinteros et al. | 156/391 |
| 2002/0005255 | A1 | * | 1/2002 | Leonardi | 156/391 |
| 2002/0162631 | A1 | * | 11/2002 | Wien et al. | 156/556 |

FOREIGN PATENT DOCUMENTS

| | | | | |
|---|---|---|---|---|
| DE | 19917454 A1 | * | 10/2000 | B65C/9/26 |
| EP | 0 855 712 A1 | | 7/1998 | G11B/23/40 |
| EP | 0 855 713 A1 | | 7/1998 | G11B/23/40 |
| FR | 2763913 A1 | * | 12/1998 | B65C/9/26 |
| WO | WO 98/26986 A1 | * | 6/1998 | B65C/9/26 |
| WO | WO 01/17860 A1 | * | 3/2001 | B65C/9/26 |

* cited by examiner

*Primary Examiner*—Richard Crispino
*Assistant Examiner*—Sue A. Purvis
(74) *Attorney, Agent, or Firm*—John L. Rogitz

(57) ABSTRACT

A device for applying an adhesive label to a disk such as a CD or DVD includes a platen and a central hub rising from the platen. The label is centered about the hub on the platen. The hub has three deformable legs that are biased outwardly and that are deformed inwardly when a disk is slid down the hub against the label, with the label adhering to the disk on contact. The disk can then be slid back up the hub to remove the disk with label. Centering structure is provided for engaging the label to hold the label centered about the hub until the disk abuts the label.

15 Claims, 3 Drawing Sheets

DISK LABEL APPLICATOR DEVICE

FIELD OF THE INVENTION

The present invention relates generally to applying labels to compact disks (CDs), digital video disks (DVDs), and the like.

BACKGROUND

Compact disks (CDs), digital video disks (DVDs), and the like are increasingly used as storage media for content, particularly for music and videos. Essentially, both types of disks have a rigid substrate that is micropitted by means of a laser to store data on the substrate. In any event, such laser-pitted disks have emerged as the entertainment content medium of choice.

Like their predecessors, LP records, CDs and DVDs are typically labelled. The labels are shaped like disks to which they are to be applied, and the labels adhere to the non-pitted surface of the disk substrate.

Devices have been provided for manually placing a label on a CD in such a way as to ensure the label is centered on the CD. For example, U.S. Pat. Nos. 5,925,200 and 5,951,819 both disclose spring-loaded plungers that support the disk to be labelled, in operative engagement with other structure of the devices that holds the labels. Depending on the particulars of the device, the plunger is moved relative to a non-moving portion of the device to cause the label to contact and, thus, adhere to the disk, with the plunger structure acting to center the label on the disk.

Another labelling device is disclosed in U.S. Pat. No. 5,902,446. As set forth therein, the device has a positioning cone with an elongated stock, a flat surface with a diameter greater than that of the stock, and a point on the end of the cone. A positioning plate having a hole in the center is also provided, and a label can be positioned on the plate, centered about the hole. The disk is slid down the stock of the cone until it rests against the flat surface, and the cone is then lowered through the hole of the positioning plate until the disk contacts the label.

As will be readily appreciated from the above discussion, existing labelling devices suffer from the drawback of requiring one or more separately made moving parts, which complicates operation and manufacture and increases costs. The present invention recognizes a need for providing a simpler, more elegant, yet effective device for applying labels to disks.

SUMMARY OF THE INVENTION

A device for applying a label having an adhesive surface to a disk having a center hole includes a platen configured to hold the label flat, adhesive surface up, and a hub centered on the platen. The hub defines a variable diameter. Specifically, the hub includes a top and plural legs depending from the top toward the platen, with each leg being biased to a first configuration, wherein the diameter of the hub is larger than the diameter of the hole of the disk, and with each leg being movable to a second configuration, wherein the diameter of the hub is equal to the diameter of the hole of the disk and an interference fit is established between the disk and the hub.

In a preferred embodiment, the platen defines a support surface and each leg defines a respective free end disposed below the surface of the platen and closely spaced therefrom. Retention elements are formed on the legs near the free ends thereof and are disposed above the surface of the platen. The retention elements cooperate with the platen to hold a label between the surface of the platen and the retention element until a disk is engaged with the hub to move the legs to the second configuration. In the business card and full-faced label applications, this cooperation of structure releases the label, such that when the disk contacts the label and the label consequently sticks to the disk, the label can be removed from the hub along with the disk. If desired, plural stays can interconnect the top of the hub and the platen.

In a so-called business card label application, the device includes label alignment trays formed on the platen. Each tray defines a straight wall that rises upwardly from the tray to engage a straight outer edge of a label. The label alignment trays are opposed to each other relative to the hub. In a so-called standard label application, the device includes opposed (relative to the hub) arcuate-shaped label alignment ridges rising from the platen and spaced from the hub, with the label diameter being established between the ridges. As set forth in greater detail below, each ridge is unitarily formed on a respective movable arm of the platen. A radial space is established between each ridge and a central platen island supporting the hub.

In another aspect, a method for applying a label to a disk includes disposing the label on a platen with the label being centered about a hub on the platen. The method also includes sliding the disk down the hub to deform the hub until the disk abuts the label, thereby causing the label to adhere to the disk. The disk is then slid back up the hub to remove the disk with label.

In still another aspect, a device for engaging an adhesive label with a disk includes a platen configured for supporting the label, and a central hub rising from the platen and configured for engaging at least a central hole of the disk. Centering structure is formed on the hub or the platen for engaging the label to hold the label centered about the hub until the disk abuts the label.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
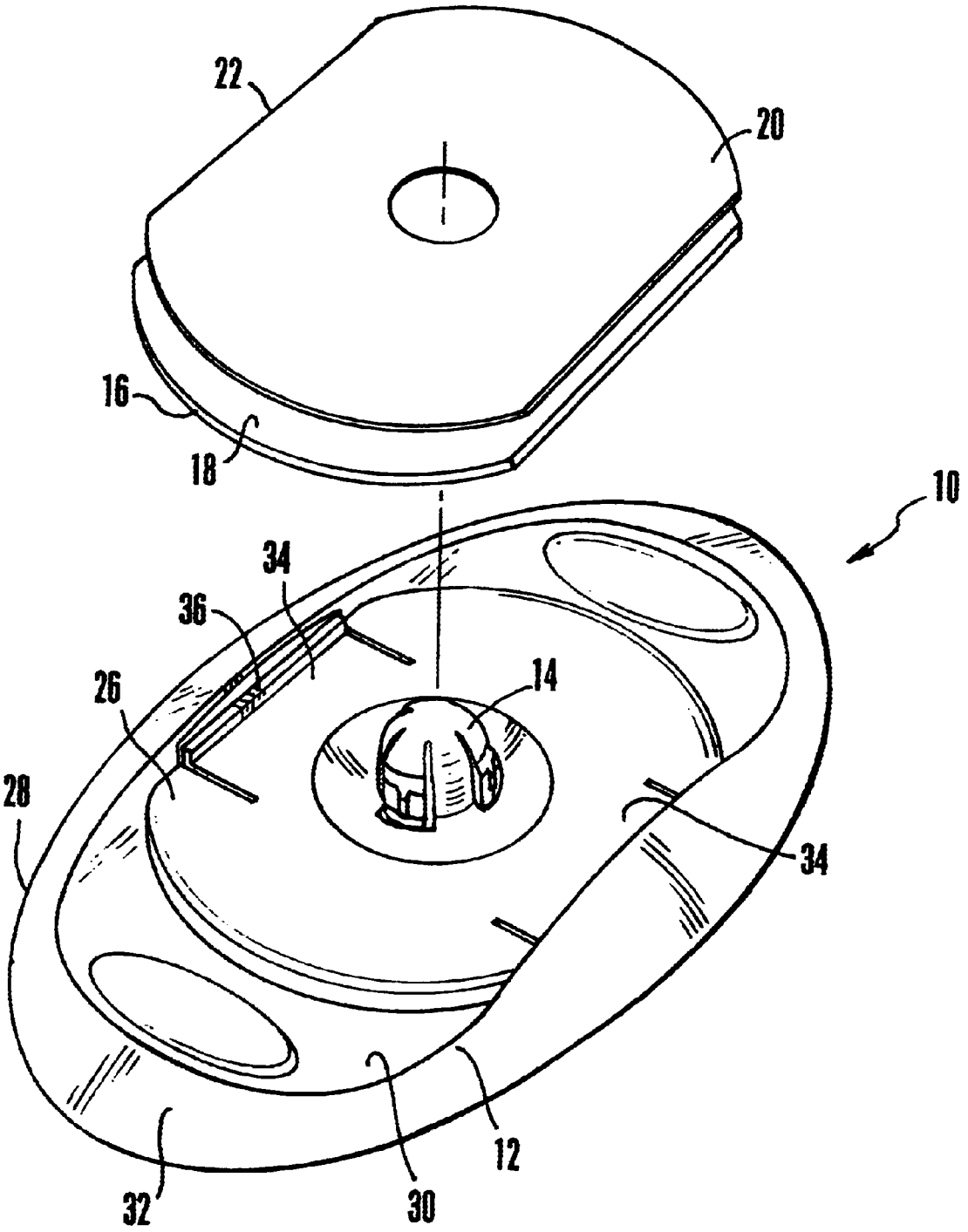
FIG. 1 is an exploded perspective view of a first embodiment, showing a business card-type disk with label in an exploded relationship with a labeller.

Referring initially to FIG. 1, a labeller, generally designated 10, is shown that includes a plastic platen 12 having a hub 14 formed centrally thereon and unitarily therewith. A label 16 having an adhesive surface 18 can be placed on the platen 12 adhesive surface 18 up, and a disk 20 is then placed over the hub 14 and slid down the hub 14 until the disk 20 contacts the label 16, causing the label 16 to adhere to the disk 20. The disk 20 with label 16 is then removed from the labeller 10 by sliding the disk 20 back up the hub 14. In the particular embodiment shown in FIG. 1, the disk 20 is not a true disk, but rather has opposed straight edges 22, rendering it into the configuration referred to as a "business card" disk. Accordingly, the label 16 has opposed straight edges 24, so that the label 16 is configured complementarily to the disk 20.

With particular regard to the platen 12, a disk support surface 26 is shaped like the label 16, and the support surface 26 rises from a generally oval base 28. The base 28 is formed with opposed gentle slopes 30 that rise up from below the support surface 26 to opposed curved end surfaces 32. Finger clearance is consequently established next to the support surface 26.

As shown in FIG. 1, the support surface 26 includes opposed rectangular support trays 34, the axis between which is orthogonal to the axis between the end surfaces 32. Each tray 34 is biased to a first configuration shown, wherein the major surface of the tray 34 is flush with the remainder of the support surface 26, and a second configuration, wherein when a person presses the disk 20 against the label 16, the trays 34 are deformed slightly down, thereby spacing the trays 34 from the label 16 and releasing the label 16. To hold the label 16 in a centered position about the hub 14, each tray 34 is unitarily formed with an outer raised straight wall 36, with the walls 36 supporting the straight edges of the label 16.

Figure 2:
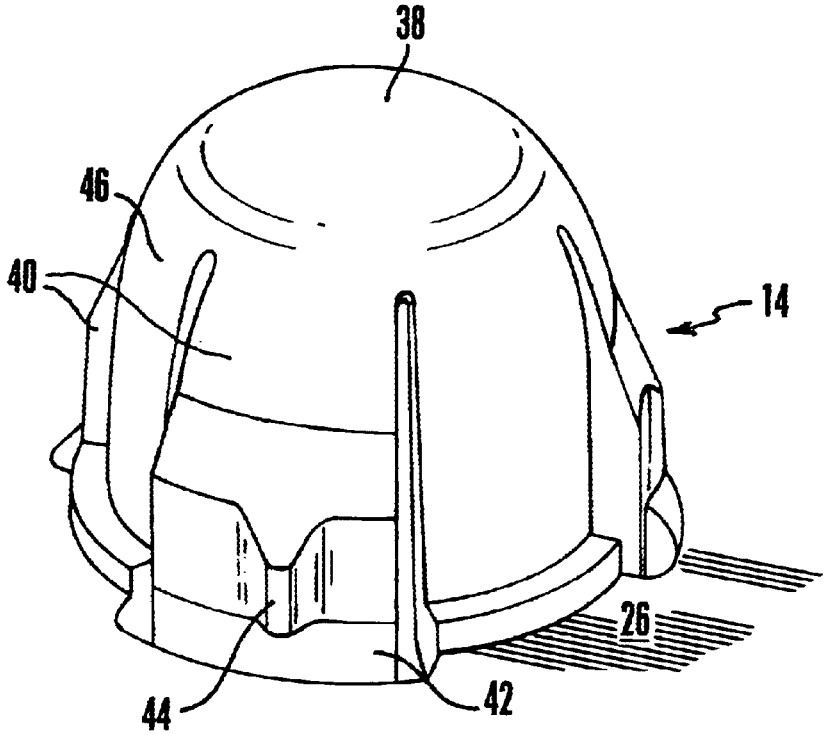
FIG. 2 is a perspective view of the present hub with one example of a retention element.

FIG. 2 shows the details of the hub 14. The hub 14, which as disclosed further below defines a variable diameter, includes a dome-shaped top 38 and plural, preferably three, legs 40 that are made unitarily with the top 38 and that depend down from the top 38 toward the platen 12. Each leg 40 biased to a first configuration shown in FIG. 2, wherein the diameter of the hub 14 is larger than the diameter of the hole of the disk 20. Also, each leg 40 is movable to a second configuration, wherein the diameter of the hub 14 is equal to the diameter of the hole of the disk 20 and an interference fit is established between the disk 20 and the hub 14. The hub 14 is moved to the second configuration when the disk 20 is slid down the hub 14 to contact the label 16.

Still referring to FIG. 2, each leg 40 defines a respective free end 42 that is disposed marginally below the support surface 26 of the platen 12. Retention elements 44 are formed on the legs 40 near the free ends 42 of the legs 40 as shown. In the illustrative embodiment shown, the retention elements 44 take the form of rounded protrusions, although other structure, such as but not limited to non-rounded protrusions, clips, slots, and the like can be used. In any case the retention elements 44 are disposed above the support surface 26. With this combination of structure, the retention elements 44 cooperate with the platen 12 to trap the label 16 between the support surface 26 of the platen 12 and the retention elements 44 until the disk 20 is engaged with the hub 14 to move the legs 40 to the second configuration. This spaces the retention elements 44 from the label 16 and thus releases the label 16 to be raised away from the platen 12 as the disk 20 is lifted. For strength and structural integrity, plural stays 46 extend between and interconnect the top 38 of the hub 14 and the platen 12. Like the legs 40, the stays 46 are also made unitarily during molding with the remaining structure of the labeller 10.

Figure 3:
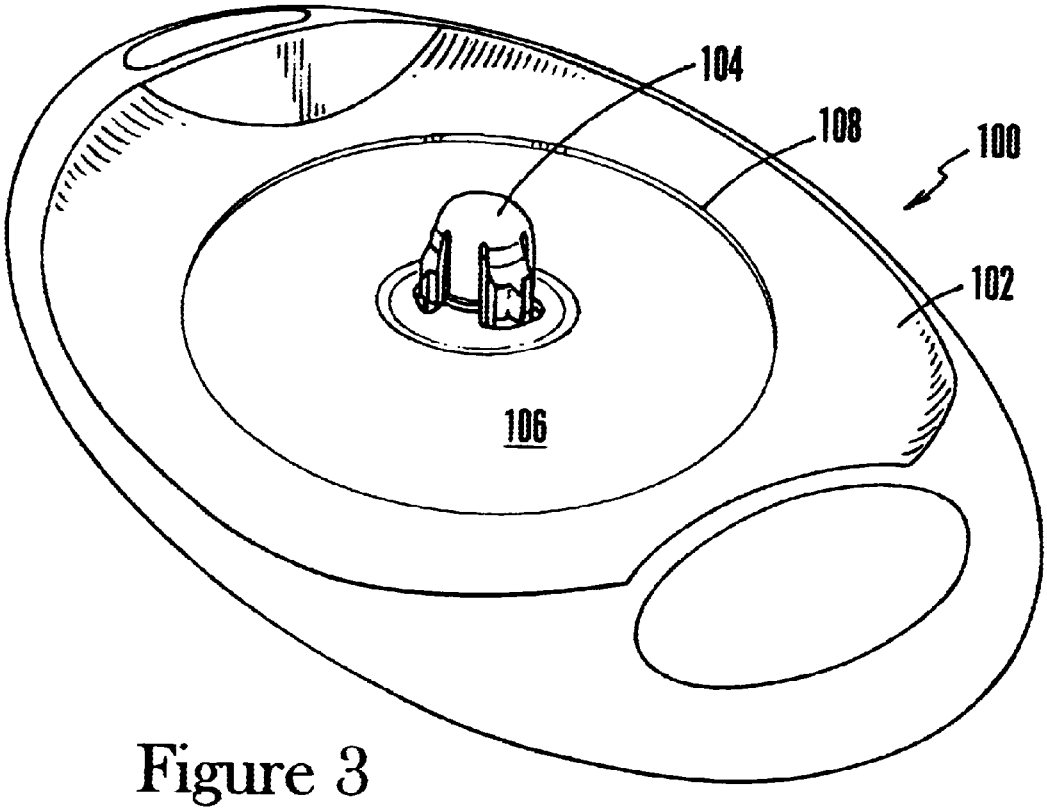
FIG. 3 is a perspective view of a second embodiment of the present labeller for applying a full-faced label to a disk.

Now referring to FIG. 3, a full-faced label labeller 100 includes a platen 102 and a hub 104 rising centrally thereon. The hub 104 is in all essential respects identical in configuration and operation to the hub 14 shown in FIG. 2. The platen 102 shown in FIG. 3, however, does not have any trays. Rather, it has a continuous smooth support surface 106 with rounded edges 108 for supporting a full-faced disk-shaped label (not shown) centered about the hub 104, on the support surface 108, adhesive surface up. A conventional disk (CD, DVD and the like) can then be slid down the hub 104 to engage the label, with the hub 104 operating to hold the label centered until the disk deforms the hub 104 to the second configuration. The diameter of the hub 104 is thus about equal to the diameter of the full-faced label, such that the hub 104 centers the label on the platen 102.

Figure 4:
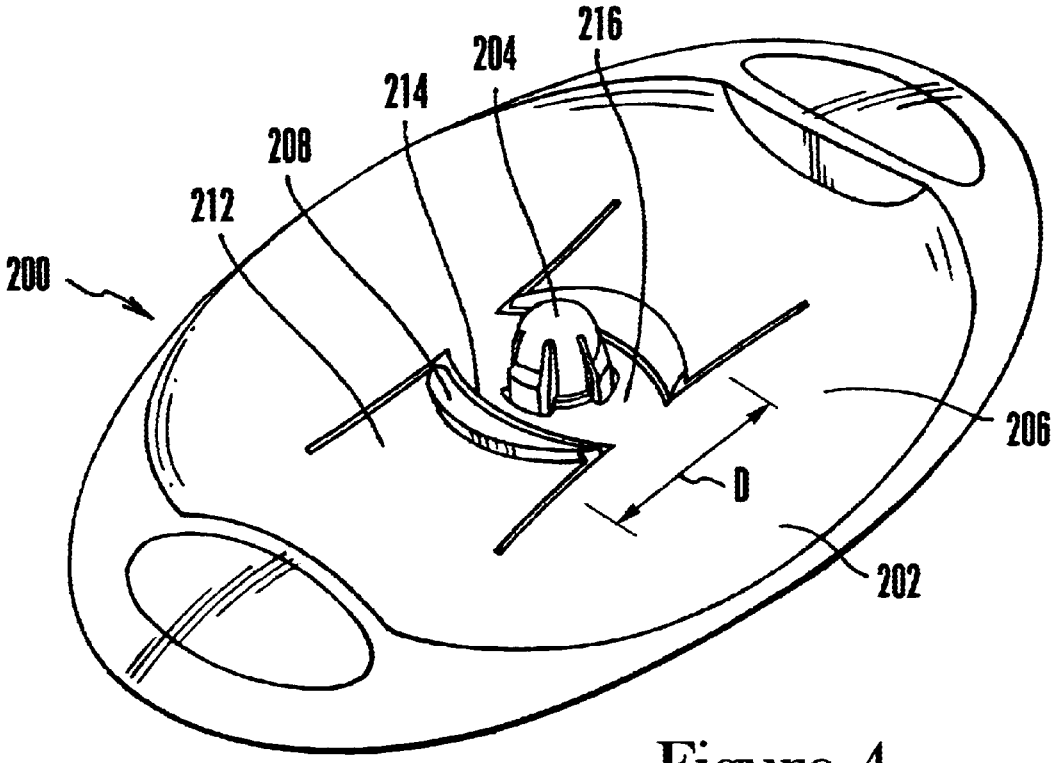
FIG. 4 is a perspective view of a third embodiment of the present labeller for applying a standard label to a disk.
Figure 5:
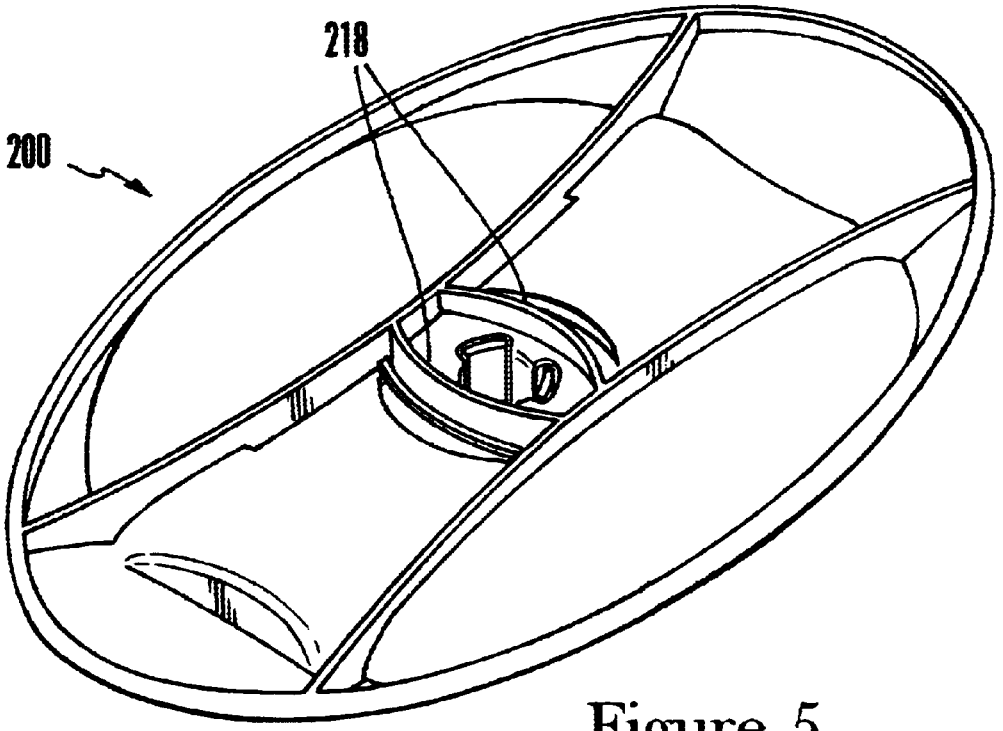
FIG. 5 is a perspective view of the device shown in FIG. 4, looking at the bottom of the device and showing the strengthening ribs.

FIGS. 4 and 5 show yet another labeller 200 configured for adhering a standard label (i.e., one that does not completely cover the entire unpitted face of a disk) to a disk (not shown) As shown, the labeller 200 includes a platen 202 and a hub 204 centrally located thereon. The hub 204 shown in FIG. 4 is in all essential respects identical to the hub 14 shown in FIG. 4, except no retention elements are provided on the hub 204.

More specifically, the platen 202 includes a support surface 206 and opposed arcuate-shaped label alignment ridges 208, each of which rises from the platen 202 and each of which is spaced from the hub 204. Together, the ridges 208 form arcs of a circle having the hub 204 at its center. The diameter "D" defined between the outer walls 210 of the ridges 208 is equal to the diameter of the hole in a standard label.

As shown, each ridge 208 is unitarily formed on a respective movable arm 212 of the platen 202. A respective radial space 214 is established between each ridge 208 and a central non-movable platen island 216 supporting the hub 204. Accordingly, each arm is biased to the first configuration shown, wherein the ridges 208 rise above the label with the outer walls 210 engaged with the hole of the label, and a second configuration, wherein when the disk is slid down the hub 204 and pressed against the label, the arms 212 are pushed downwardly away from the hub 204 to release the label such that it can be removed with the disk. In this sense, the ridges 212 establish centering structure for the label. The hubs 14, 104, 204, of course, establish centering structure for the disks and, in the case of the hubs 14, 104, for the labels as well.

FIG. 5 shows that arcuate strengthening ribs 218 can be formed along the bottom edges of the ridges 208, below the support surface of the platen 202. The ribs 218 serve to strengthen the labeller 200.

It may now be appreciated that in the preferred embodiments shown, each labeller 10, 100, 200 is made of a single piece of molded plastic with a minimum of moving parts, with no part of the labellers 10, 100, 200 requiring human touch other than simply placing a label on the respective platens and then sliding disks down the respective hubs.

While the particular DISK LABEL APPLICATOR DEVICE as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element component, or method step in the present disclosure is intended to be dedicated to the public regardless of whether the element component, or method step is explicitly recited in the claims. No claim element herein is to be construed under the provisions of 35 U.S.C. §112, sixth paragraph, unless the element is expressly recited using the phrase "means for" or, in the case of a method claim, the element is recited as a "step" instead of an "act".

We claim:

1. A device for applying a label having a adhesive surface to a disk having a center hole defining a diameter, comprising:

a platen configured to hold the label flat, adhesive surface up; and a hub centered on the platen and defining a variable diameter, the hub including a top and plural generally vertically-oriented legs depending from the top toward the platen, each leg including a first end oriented above a second end relative to the platen, each leg being biased to a first configuration, wherein the diameter of the hub is larger than the diameter of the hole of the disk, each leg being movable to a second configuration, wherein the diameter of the hub is equal to the diameter of the hole of the disk and an interference fit is established between the disk and the hub, the legs not being movable by pressing on the hub.

2. The device of claim 1, wherein the platen defines a surface and each leg defines a respective free end juxtaposed with the surface of the platen and closely spaced therefrom, and the device further comprises at least one retention element on at least one leg near the free end thereof and disposed above the surface of the platen and closely spaced therefrom, the retention element cooperating with the platen to hold a label between the surface of the platen and the retention element until a disk is engaged with the hub to move the legs to the second configuration.

3. The device of claim 1, further comprising plural stays interconnecting the top of the hub and the platen.

4. The device of claim 1, wherein the legs are formed unitarily with the top of the hub.

5. The device of claim 1, wherein the hub is formed unitarily with the platen.

6. The device of claim 1, comprising at least three legs.

7. The device of claim 1, wherein the top of the hub is dome-shaped.

8. The device of claim 1, further comprising at least one label alignment tray formed the platen and defining a straight wall rising upwardly from the tray to engage a straight outer edge of a label.

9. The device of claim 8, further comprising two label alignment trays opposed to each other relative to the hub.

10. The device of claim 1, wherein the label is formed with a central hole defining a label diameter, and the device further comprises opposed arcuate-shaped label alignment ridges rising from the platen and spaced from the hub, the label diameter being established between the ridges.

11. The device of claim 10, wherein each ridge is unitarily formed on a respective movable arm of the platen, and wherein a respective radial space is established between each ridge and a central platen island supporting the hub.

12. A device for engaging an adhesive label with a disk, comprising:

an adhesive label;

a coverless platen configured for supporting the label;

a central hub rising from the platen and configured for engaging at least a central hole of the disk; and centering structure formed on at least one of: the hub, and the platen, for engaging the label to hold the label centered about the hub until the disk abuts the label, wherein the centering structure includes:

a hub top and plural legs depending from the top toward the platen, each leg being biased to a first configuration, wherein the diameter of the hub is larger than the diameter of a central hole of the disk, each leg being movable to a second configuration, wherein the diameter of the hub is equal to the diameter of the central hole of the disk and an interference fit is established between the disk and the hub; and at least one retention element on at least one leg near a free end thereof and disposed above the platen and closely spaced therefrom, the retention element cooperating with the platen to hold a label between the platen and the retention element until a disk is engaged with the hub to move the legs to the second configuration.

13. A device for engaging an adhesive label with a disk, comprising:

an adhesive label;

a coverless platen configured for supporting the label;

a central hub rising from the platen and configured for engaging at least a central hole of the disk; and centering structure formed on at least one of: the hub, and the platen, for engaging the label to hold the label centered about the hub until the disk abuts the label; and two label alignment trays opposed to each other relative to the hub, at least one tray defining a straight wall rising upwardly from the tray to engage a straight outer edge of a label.

14. A device for engaging an adhesive label with a disk, comprising:

an adhesive label;

a coverless platen configured for supporting the label;

a central hub rising from the platen and configured for engaging at least a central hole of the disk; and centering structure formed on at least one of: the hub, and the platen for engaging the label to hold the label centered about the hub until the disk abuts the label wherein the label is formed with a central hole defining a label diameter, and the centering structure includes opposed arcuate-shaped label alignment ridges rising from the platen and spaced from the hub, the label diameter being established between the ridges.

15. The device of claim 14, wherein each ridge is unitarily formed on a respective movable arm of the platen, and wherein a respective radial space is established between each ridge and a central platen island supporting the hub.

* * * * *